US006012716A

United States Patent [19]

Adell

[11] Patent Number: 6,012,716

[45] **Date of Patent: *Jan. 11, 2000**

[54] LOTTERY NUMBER PICKER AND METHOD

[76] Inventor: Robert Adell, 31800 S. Brandingham, Franklin, Mich. 48025

[ * ] Notice: This patent is subject to a terminal disclaimer.

[21] Appl. No.: 08/492,376

[22] Filed: Jun. 19, 1995

[51] Int. Cl.[7] ..... A63F 3/06; A63F 9/06

[52] U.S. Cl. ..... 273/144 B; 273/144 R; 273/138.1

[58] Field of Search ..... 273/144 B, 145 C, 273/144 R, 144 A, 145 LA, 138 R, 269

[56] References Cited

U.S. PATENT DOCUMENTS 4,533,143 8/1985 Albright et al. ..... 273/144 B
5,011,148 4/1991 Stebing ..... 273/144 B
5,454,567 10/1995 Adell ..... 273/144 B

*Primary Examiner*—Benjamin H. Layno
*Attorney, Agent, or Firm*—Alex Rhodes

[57] ABSTRACT

A number picker for placing bets in lotteries and a method for manufacturing the number picker. The number picker is comprised of a platform having an upper space for storing small thin circular disks, and a lower space for storing a business card and/or advertising material; an upper cover for enclosing the disks, a lower case for enclosing the business card and/or advertising material and a chain for carrying keys. One characteristic of the lottery number picker is that each of the disks has identical numbers on parallel upper and lower faces. Another characteristic feature of the invention is that the numbered disks are randomly installed in the platform. A third characteristic feature is that the business card and/or advertising material are installed after the lower cover is attached to the platform.

10 Claims, 5 Drawing Sheets

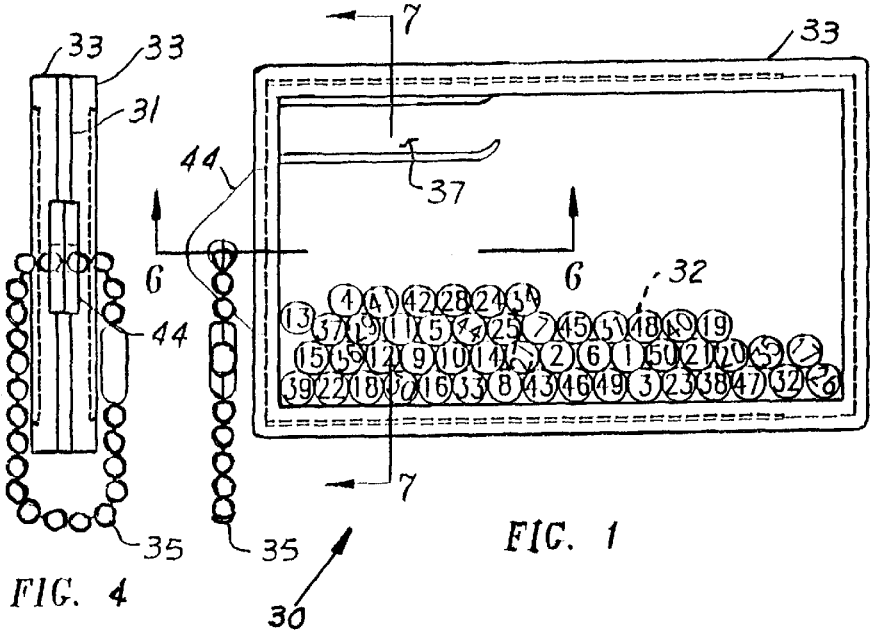
FIG. 1
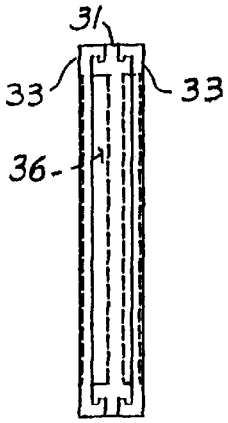
FIG. 3
FIG. 4
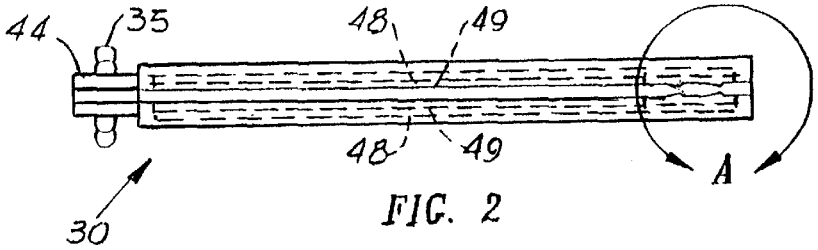
FIG. 2
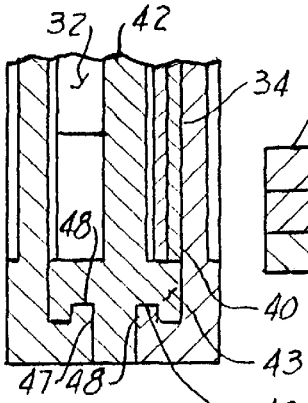
FIG. 8
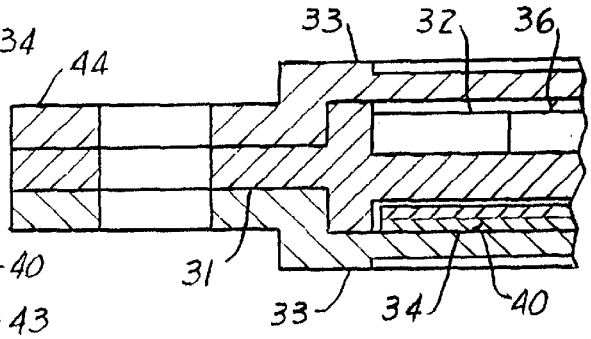
FIG. 6
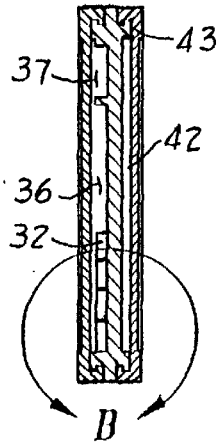
FIG. 7
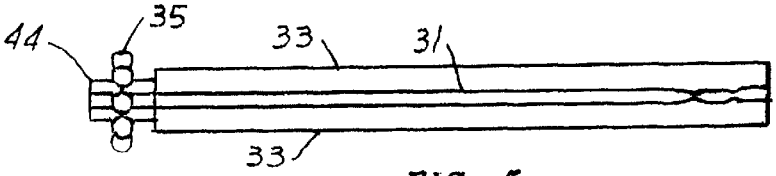
FIG. 5

LOTTERY NUMBER PICKER AND METHOD

FIELD OF THE INVENTION

This invention relates to lottery number pickers and more particularly to lottery pickers having pluralities of small thin circular disks.

BACKGROUND OF THE INVENTION

Each year billions of dollars are wagered in government operated lotteries. Lotteries are a major revenue source in the United States and foreign countries. Thirty-three states and the District of Columbia have government operated lotteries. The lotteries have been so effective that a national lottery may be implemented as a means for reducing the Federal budget deficit.

Lottery number pickers allow bettors to randomly pick numbers for placing bets in lotteries. One type of lottery number picker is disclosed in my pending applications Ser. Nos. 08/394,768 and 08/394,769.

One problem in manufacturing lottery number pickers is the complexity and diversity in state and foreign lotteries. By way of example, twenty-seven states have daily lotteries which require bettors to select a three or four digit number. Thirty-two states and the District of Columbia have weekly and semi-weekly lotteries which require bettors to pick six numbers from sixteen different sets of numbers ranging from 25 to 54 numbers.

The complexity and diversity has discouraged manufacturers from producing lottery number pickers. Manufacturers are unwilling to risk large sums in low priced products having high labor, packaging, and inventory costs; particularly, products such as lottery number pickers. The public will not purchase lottery pickers if they are high priced. Bettors would rather spend their money placing bets rather than for purchasing number pickers.

Another problem with lottery number pickers wherein large quantities of small thin circular disks are stored in small spaces, is the amount of labor which is required to orient the disks so that the numbers are visible to a user, particularly when disks are about 6 mm or less in diameter and about 1.5 mm thick. Moreover, when disks have to be oriented, the probability for error is high.

Another problem which is associated with lottery number pickers containing personalized items, such as business cards and advertising material, is high labor and inventory costs because of the inherent diversity in card and advertising material.

SUMMARY OF THE INVENTION

The present invention overcomes the foregoing problems by providing small circular numbered disks which can be installed without regard to orientation and a means for installing business cards and/or advertising material after assembly of a number picker.

One characteristic feature of the invention is that small thin circular disks are marked with numbers on opposite faces of the disks. This feature eliminates the requirement of orienting the disks during assembly of the picker.

Another characteristic feature of the invention is the means for installing business cards and/or advertising material after the lottery picker has been assembled. This improvement reduces the amount of inventory a manufacturer must maintain. It also permits end users to install or replace business cards or advertising material.

Further benefits, features and embodiments of the invention will be apparent from the ensuing description and accompanying drawings which describe the invention in detail. A preferred embodiment is disclosed in accordance with the best mode which is contemplated for practicing the invention and the specific features in which exclusive property rights are claimed are set forth in each of the numbered claims which are appended to the detailed description.

BRIEF DESCRIPTION OF THE DRAWINGS

The invention will be better understood and further objects, characteristic features, details and advantages thereof will appear more clearly with reference to the diagrammatic drawings illustrating a presently preferred specific embodiment of the invention by way of non-limiting example only.

FIG. 1 is a plan side view of the lottery number picker.

FIG. 2 is a front view of a lottery number picker according to the invention.

FIG. 3 is a left end view of the lottery number picker.

FIG. 4 is a left end view of the lottery number picker.

FIG. 5 is a rear view of the lottery number picker.

FIG. 6 is an enlarged cross-sectional view taken on the line 6—6 in FIG. 1.

FIG. 7 is an enlarged cross-sectional view taken on the line 6—6 in FIG. 1.

FIG. 8 is an enlarged partial view in circle "B" of FIG. 7.

DETAILED DESCRIPTION OF THE PREFERRED EMBODIMENT

Figure 12:
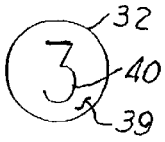
FIG. 12 is bottom view of the numbered disk.

With reference to drawings, wherein like numerals designate like and corresponding parts throughout the several views, in FIGS. 1 through 15, inclusive, are shown a generally rectangular lottery number picker 30, according to the present invention.

The lottery number picker 30 comprises a transparent platform 31 for storing numbered disks 32, a card 34 and/or advertising material; a plurality of very small thin circular numbered disks 32 stored in the platform 31; and a pair of identical transparent covers 33 for enclosing the numbered disks 32, card 34 and/or advertising material. Also, included is a chain 35 for carrying keys. The platform 31 and covers 33 are preferably made of a low cost transparent material having a small amount of flexibility, such as the polymer polystyrene. The small numbered disks 32, by way of example, are about 5.5 mm in diameter and 1.5 mm thick.

The generally rectangular platform 31 has a shallow upper space 36 for storing the numbered disks 32 with an integral trap 37 for capturing a set of disks 32 corresponding to a number or set of numbers in a lottery. The depth of the upper space 36 is slightly greater than the thickness of a disk 32 to prevent stacking of disks 32 when the lottery number picker 30 is agitated to capture disks 32 in the trap 37.

Figure 11:
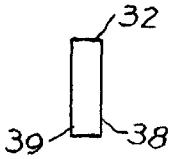
FIG. 11 is a front view of the numbered disk.
Figure 10:
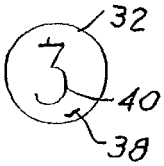
FIG. 10 is an enlarged plan view of a small thin circular numbered disk.
Figure 9:
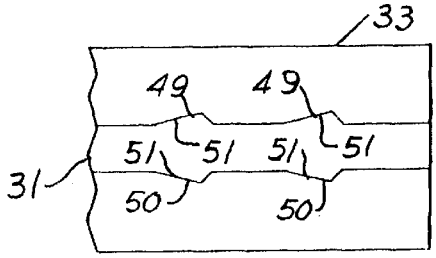
FIG. 9 is an enlarged view in circle "A" in FIG. 1.

The disks 32 are depicted in FIGS. 10 through 12. On circular upper 38 and lower 39 faces of each disk 32 are identical numbers 40 corresponding to a number or a digit of a number in a lottery. Disks 32 having numbers 40 on opposite faces allow them to be randomly installed in the shallow upper space 36 of the platform 31 without regard to orientation of the faces 38, 39. This feature of numbers on opposite faces eliminates the requirement of orienting the faces 38, 39 of the disks 32.

The length of the trap 37 is determined by the number of disks 32 which are to be captured. By way of example, when six numbers are to be selected from a set of consecutive numbers ranging from 1 through 60, a trap 37 is provided having a length which allows six of the numbered disks 32 to be captured from the sixty disks 32 in the platform 31.

In the bottom of the platform 31 there is a shallow space 41 for receiving the business card 34 and/or advertising material. A thin horizontal wall 42 separates the upper 36 and lower 41 spaces. An outer wall 43 extends around the platform 31 and joins the horizontal wall 42. At one end portion of the covers 33 and platform 31 there are outward extending portions 44 with apertures 45 which receive the chain 35 for carrying keys.

With reference to FIG. 8, along the sides of the platform 31 rectangular upper 46 and lower 47 grooves engage inward extending rectangular ribs 48 of the covers 33. On end portions of the sides of the platform 31 are upper 49 and lower 50 pairs of angular protuberances. The protuberances 49, 50 engage angular depressions 51 of the covers 33 to retain the covers 33 longitudinally on the platform 31.

Figure 15:
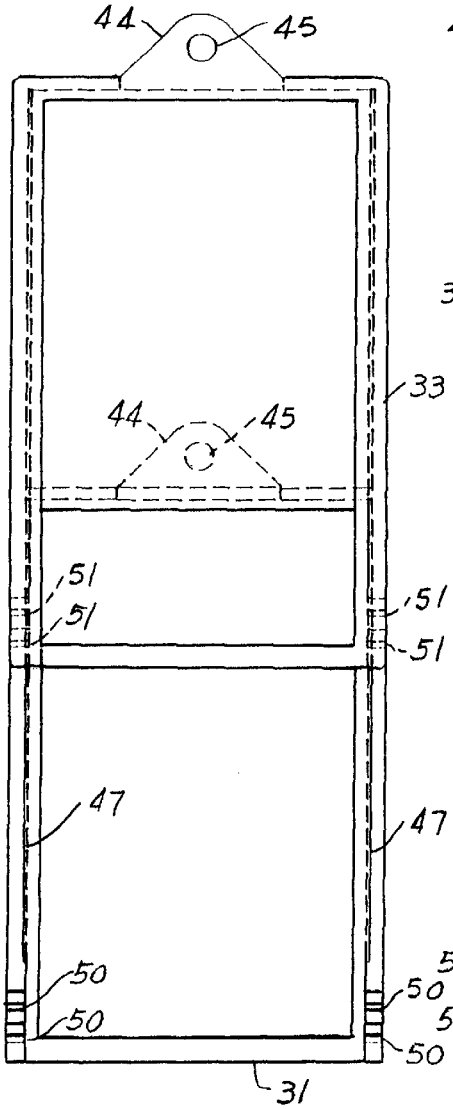
FIG. 15 is a bottom view of the lottery number picker in partially assembled form.
Figure 14:
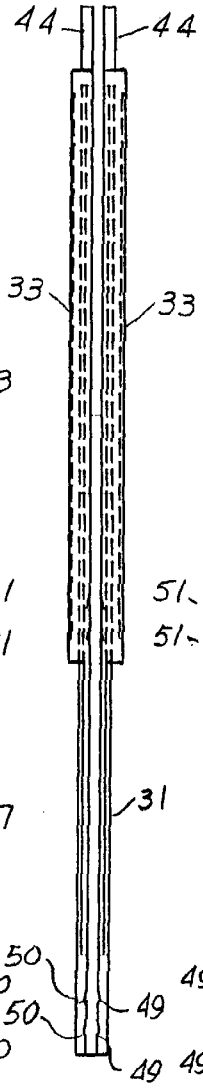
FIG. 14 is a right side view of the lottery number picker in partially assembled form.
Figure 13:
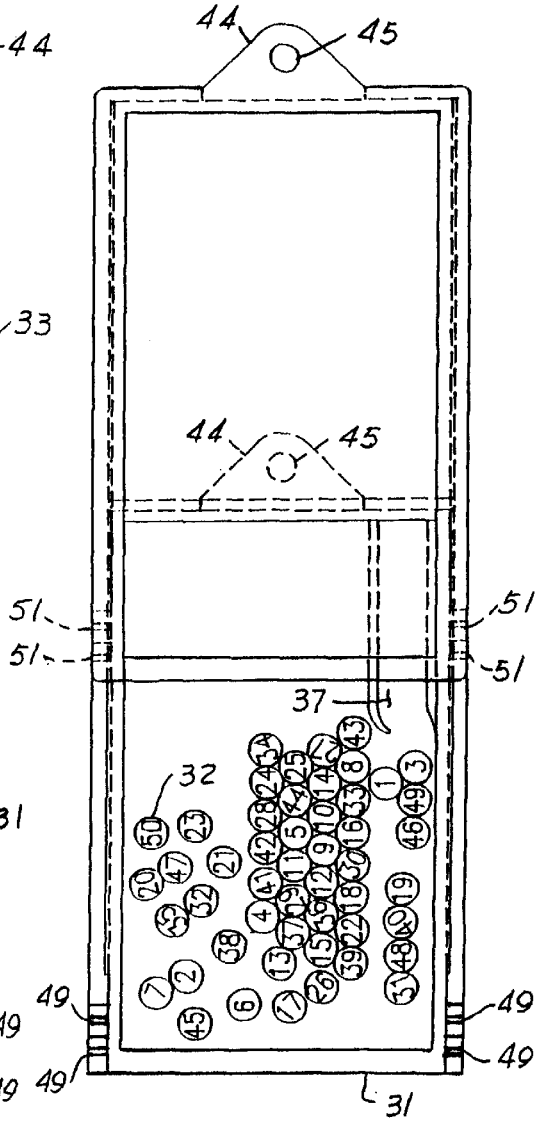
FIG. 13 is a plan view of the lottery number picker in partially assembled form.
Figure 19:
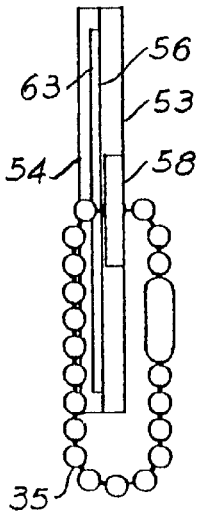
FIG. 19 is a right end view of the alternate embodiment.
Figure 16:
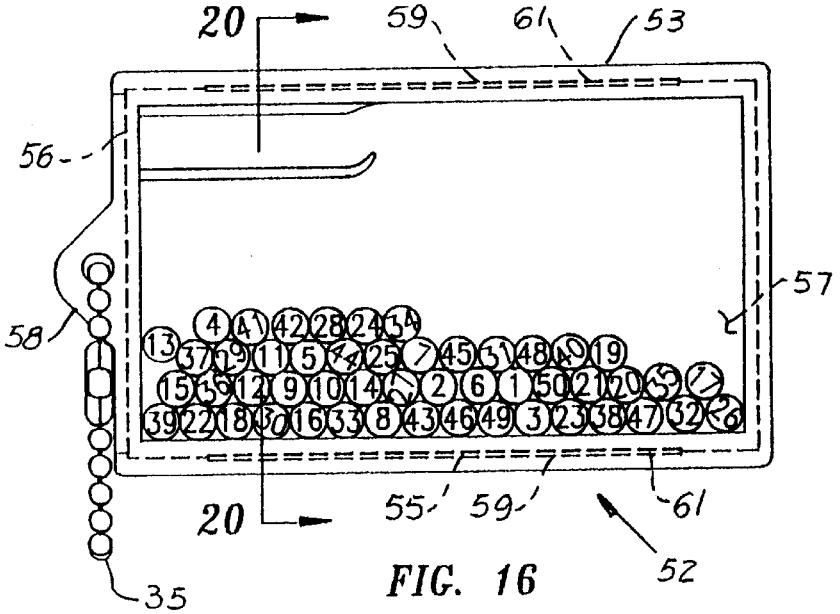
FIG. 16 is a plan view of an alternate embodiment of the lottery number picker.
Figure 17:
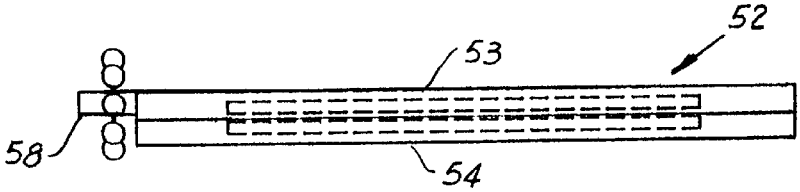
FIG. 17 is a front view of the alternate embodiment.
Figure 20:
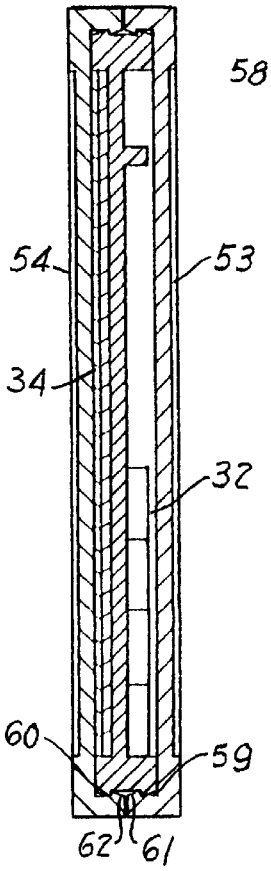
FIG. 20 is an enlarged cross-sectional view taken on the line 20—20 in FIG. 16.
Figure 18:
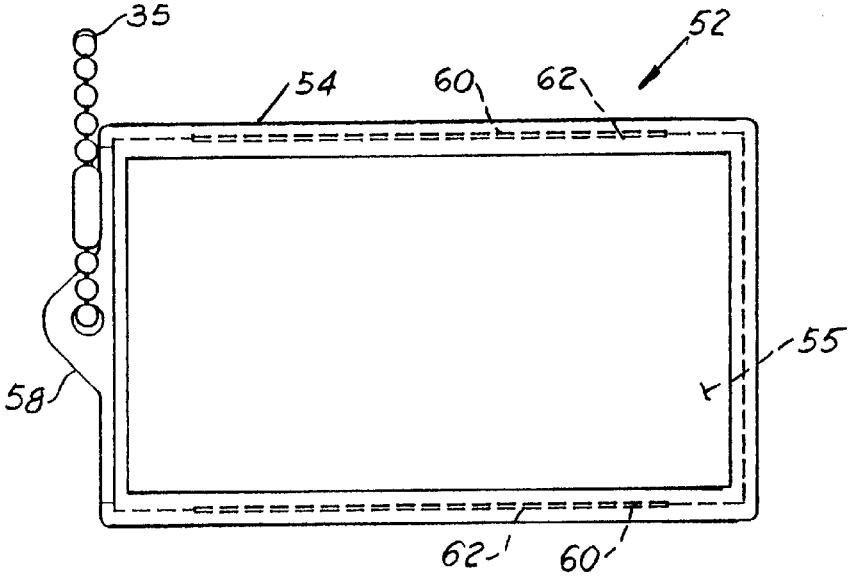
FIG. 18 is a bottom view of the alternate embodiment.
Figure 21:
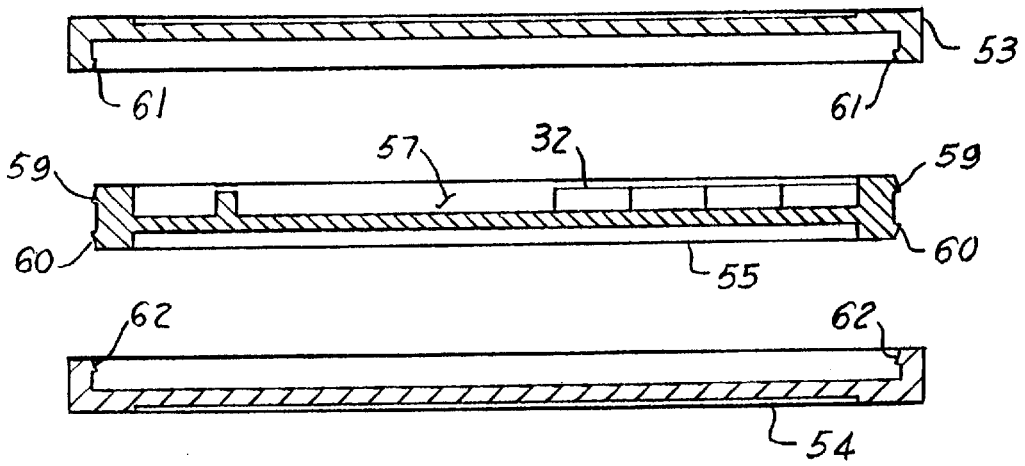
FIG. 21 is a transverse cross-sectional view of the alternate embodiment in partially assembled form taken on the line 20—20 in FIG. 16.
Figure 23:
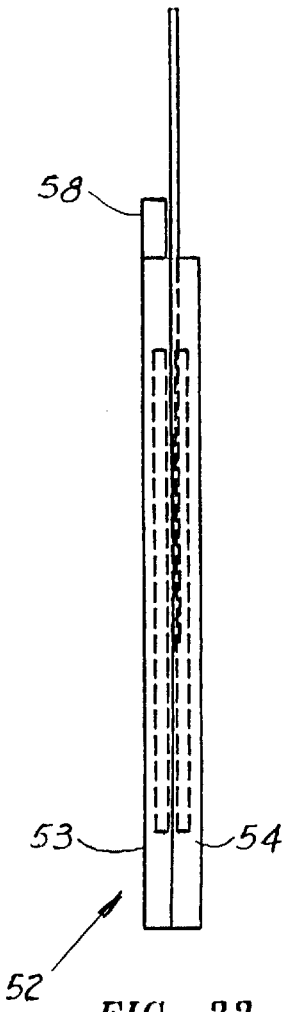
FIG. 23 is a front view of the alternate embodiment and the business card in partially assembled form.
Figure 22:
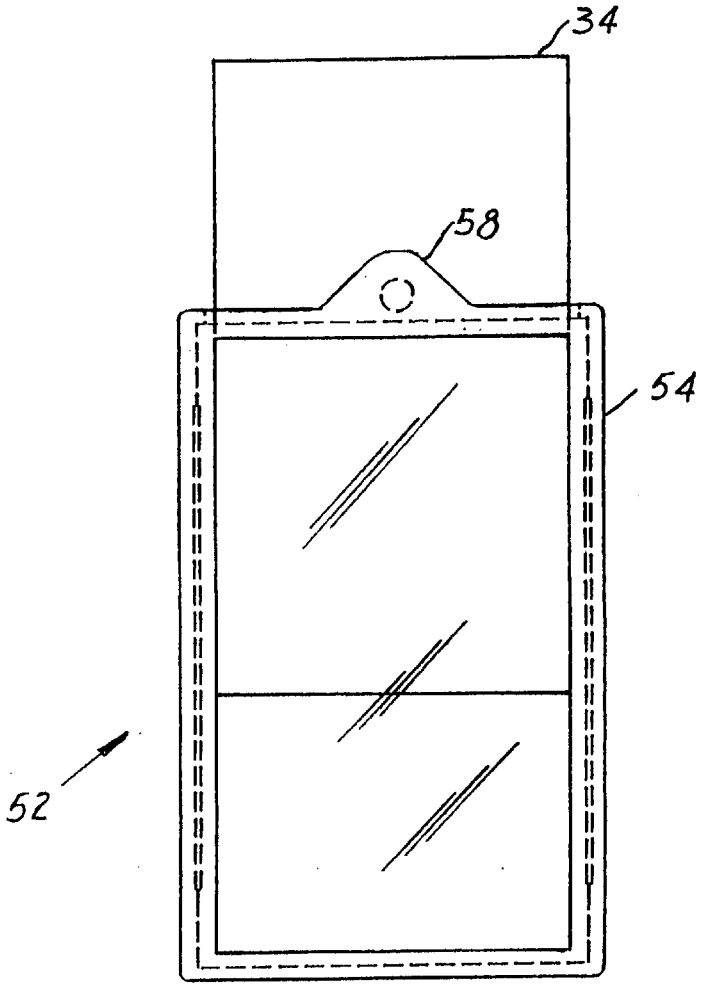
FIG. 22 is a bottom view of the alternate embodiment and a business card in partially assembled form.

Referring now to FIGS. 13 through 15, during an assembly of the lottery number picker 30, the numbered disks 32 are first randomly inserted into the shallow upper space 36 of the platform 31 without regard to the orientation of the circular faces 38, 39. The inward extending rectangular ribs 48 of one of the covers 33 are slidably engaged with the upper rectangular grooves 46 of the platform 31 as shown in FIGS. 13 and 14 and the cover 33 is moved on the platform 31 until the depressions 51 of the cover 33 engage the upper protuberances 49 of the insert 31. During the engagement of the protuberances 49 with the depressions 51, the cover 33 deflects a slight amount.

Referring now to FIGS. 14 and 15, the platform 31 is next inverted and the inward extending rectangular ribs 48 of a second cover 33 are slidably engaged with the lower rectangular grooves 47 of the platform 31 and the depressions 51 of the cover 33 are engaged with the insert's lower protuberances 50 to retain the cover 33 on the lower portion of the platform 31.

After the cover 33 has been assembled to the lower portion of the platform 31, a business card 34 and/or advertising material is installed by slidably moving the lower cover 33 on the platform 31 and installing the card 34 and/or advertising material in the platform's lower space 41.

In FIGS. 16 through 23, an alternate embodiment 52 is shown which is similar to the first embodiment 30 except for a means of retaining upper transparent covers 53, 54 to a platform 55 and an opening 56 in an end portion of the embodiment 52 for inserting a business card 34 and/or advertising material. The lottery picker 52 is comprised of the transparent platform 55 having a shallow upper space 57 for storing a plurality of small thin numbered disks 32 and a trap 37 for capturing some of the disks 32, the transparent upper cover 53 attached to an upper portion of the platform 55, the plurality of small thin circular numbered disks 32, the transparent lower cover 54 attached to a lower portion of the platform 55 and a chain 35 attached to an outward extending end portion 58 of the upper cover 53. The trap 37 shown in the drawings allows six numbered disks 32 to be captured from a set of fifty disks 32.

Along the sides of the platform 55 upper 59 and lower 60 angular ribs extend outwardly and engage inward extending angular ribs 61, 62 on the upper 53 and lower 54 covers. In the lower cover 54 there is a recess 63 which forms three sides of the opening 56 for installing a business card 34 and/or advertising material after the lower cover 54 has been attached to the platform 55.

The upper cover 53 and lower cover 54 are assembled to the platform 55 by aligning the covers 53, 54 with the platform 55 and depressing the covers 53, 54 to engage the inward extending angular ribs 61, 62 with the outward extending ribs 59, 60 of the platform 55.

Figure 24:
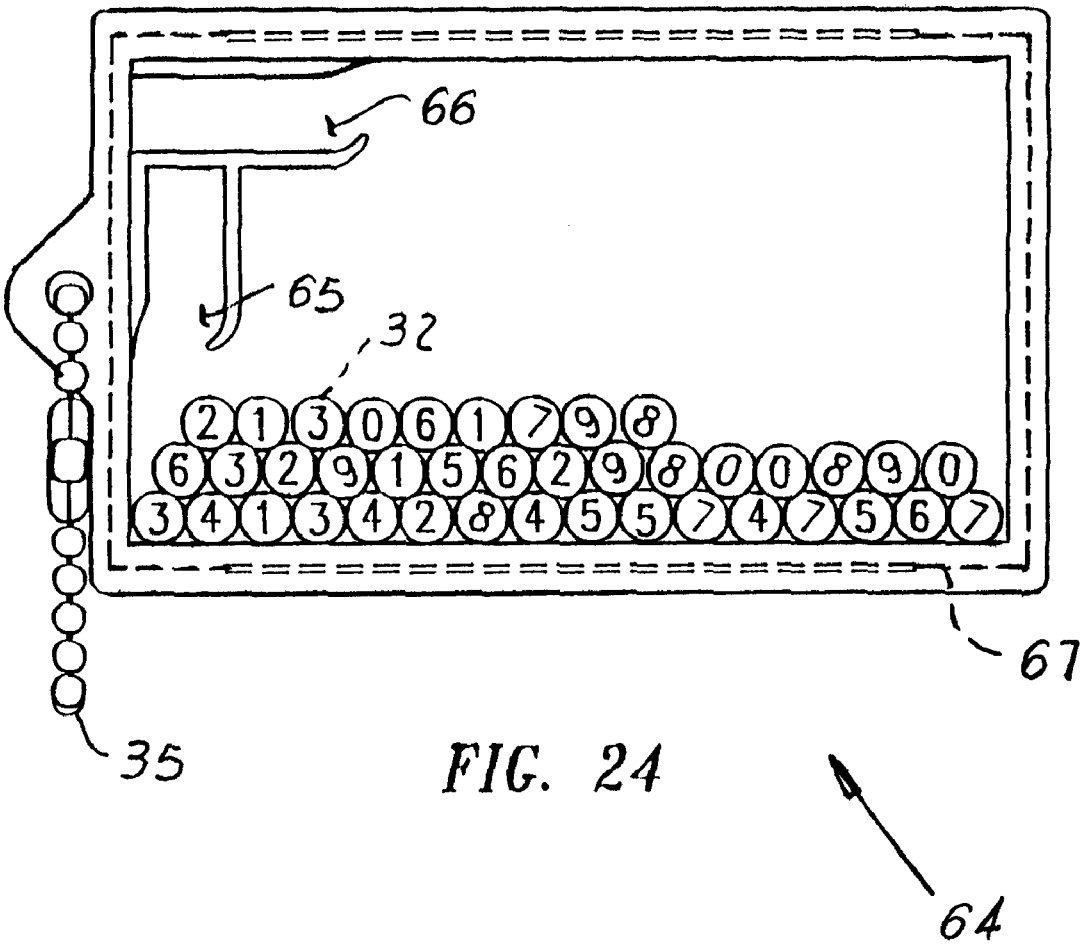
FIG. 24 is a plan view of a second alternate embodiment of the invention.

In FIG. 24 is shown an alternate embodiment 64 which is similar in all respects to the embodiment 52 of FIGS. 16 through 23 except for a pair of orthogonal traps 65, 66 in a platform 67 for capturing three or four of the numbered disks 32 stored in a platform 67.

From the foregoing, it will be appreciated that my invention provides a lottery number picker and method having thin circular numbered disks which reduces manufacturing and inventory costs and allows a user or manufacturer to install a business card and/or advertising material after the picker has been assembled.

Although only several embodiments of my invention have been shown for the purpose of describing my invention and the manner of using the invention, it is not my intention to limit the claims to these embodiments, since other embodiments become obvious after having the benefit of the disclosure, by such changes as shape, material and arrangement of parts without departing from the spirit thereof.

I claim:

1. In combination with a non-transparent business and/or advertising card a lottery number picker for placing bets in lotteries comprising a generally rectangular platform for storing numbered disks, said non-transparent business and/or advertising card, said platform having an upper space for storing a plurality of thin circular numbered disks and a trap for capturing some of said disks, a lower space for storing said business and/or advertising card, a thin horizontal wall for separating said upper and said lower spaces, an outer wall extending around said platform, a means for retaining a cover to an upper side portion of said platform for enclosing a plurality of numbered disks in said upper space and a means for retaining a cover to a lower side portion of said platform for enclosing said non-transparent business and/or advertising card in said lower space; and a plurality of thin disks in said upper space of said platform between said non-transparent card and said transparent cover, each of said disks having a circular upper face and a parallel circular lower face, said upper face marked with a number corresponding to a number of a lottery and said lower face having a number which is identical to said number on said upper face whereby said disks can be randomly installed in said space without regard to the orientation of said upper and said lower faces of said disks in said platform.

2. The lottery number picker recited in claim 1 wherein said platform is formed from a transparent material.

3. The lottery number picker recited in claim 1 wherein said means for retaining said upper cover and said lower cover to said platform comprises a pair of inward extending rectangular ribs on opposite side portions of each of said covers and a pair of inward extending rectangular grooves on opposite side portions of said platform above and below said horizontal wall for slidably engaging said ribs of said covers, a pair of protuberances on opposite side portions of said platform for longitudinally retaining said covers to said platform, and a pair of recessed portions on said opposite side portions of each of said covers for receiving said pairs of protuberances.

4. The lottery number picker recited in claim 1 wherein said means for retaining said upper cover and said lower cover to said platform comprises a pair of inward extending angular ribs on opposite side portions of each of said covers, and upper and lower pairs of outward angular ribs on opposite side portions of said platform for engaging said inward extending angular ribs of each of said covers.

5. The lottery number picker recited in claim 4 further comprising a recess in an end portion of said lower cover for inserting a business card and/or advertising material after said lower cover is assembled to said platform.

6. The lottery number picker recited in claim 4 further comprising an outward extending end portion on at least one of said covers, said end portion having an aperture for receiving a chain; and a chain extending through said aperture for carrying keys.

7. In a lottery number picker having a plurality of small thin circular disks stored in a shallow space in a member of said picker for placing bets in lotteries, the improvement comprising a plurality of thin disks, each disk having parallel circular upper and lower faces of about 6mm in diameter and about 1.5 mm thick, said upper and lower faces marked with a number corresponding to a number of a lottery whereby said disks can be randomly installed in said space without regard to the orientation of said upper and said lower faces of said disks.

8. In a method for assembling a combined business and/or advertising card and lottery number picker of the type having a non-transparent business and/or advertising card and a plurality of small thin numbered disks stored in a shallow space of a platform and a transparent cover for viewing numbers on said disks attached to said platform, the improvement comprising the steps of randomly installing small thin circular disks in said shallow space of said platform, each of said disks having parallel opposite circular faces and identical numbers marked on said opposite circular faces, without regard to orienting said opposite faces in said platform and installing said non-transparent business and/or advertising card between said transparent cover and said disks such that only one of said faces of each of said disks is in said view of a user.

9. The improved method recited in claim 8 further comprising the step of slidably engaging inward extending rectangular ribs on sides of a transparent cover with rectangular grooves on sides of said platform and the step of sliding said cover on said platform to engage protuberances on end portions of said side of said platform with recesses on end portions of said sides of said cover to enclose said disks and retain said cover to said platform.

10. The improved method recited in claim 8 further comprising the steps of attaching a transparent cover to a lower portion of said platform and inserting a business card and/or advertising material through a recess in an end portion of said lower cover.

* * * * *